US006698757B1

(12) United States Patent
Timpano

(10) Patent No.: US 6,698,757 B1
(45) Date of Patent: Mar. 2, 2004

(54) CASINO GAME

(76) Inventor: Mike Timpano, 364 Grenville Ave., Orillia, Ontario (CA), L3V 7P7

( * ) Notice: Subject to any disclaimer, the term of this patent is extended or adjusted under 35 U.S.C. 154(b) by 0 days.

(21) Appl. No.: 09/693,523

(22) Filed: Oct. 20, 2000

Related U.S. Application Data

(63) Continuation-in-part of application No. 09/267,191, filed on Mar. 12, 1999, now abandoned.
(60) Provisional application No. 60/077,811, filed on Mar. 12, 1998.

(51) Int. Cl.[7] ..... A63F 1/00
(52) U.S. Cl. ..... 273/274; 273/292
(58) Field of Search ..... 273/274, 292, 273/309; 463/12, 13

(56) References Cited

U.S. PATENT DOCUMENTS 5,538,252 A * 7/1996 Green
5,584,486 A * 12/1996 Franklin
5,678,821 A * 10/1997 Hedman
5,810,361 A * 9/1998 Kadlic
5,845,907 A * 12/1998 Wells
6,102,402 A * 8/2000 Scott et al.
6,105,964 A * 8/2000 Maahs
6,206,374 B1 * 3/2001 Jones
6,206,375 B1 * 3/2001 Wichinsky
6,237,916 B1 * 5/2001 Webb
2001/0040344 A1 * 11/2001 Zahedi

* cited by examiner

*Primary Examiner*—William M. Pierce
(74) *Attorney, Agent, or Firm*—Robert Ryan Morishita; Anderson & Morishita, LLC

(57) ABSTRACT

A method for playing a game in which players play against a casino using a standard fifty two card deck plus at least one joker, which acts as a wild card. In an alternate embodiment, the game may be played on an electronic device and electronic representations of the cards may be used. Each player makes a base wager and, optionally, a bonus wager. Five cards are dealt to each player and to the dealer. Any player having a predetermined automatic winning holding is immediately rewarded and excluded from further participation in the game except to resolve any bonus wager. Each player not having an automatic winning holding has the option to discard and replace a single card. The dealer hand is revealed the dealer receives a single additional card. In turn, each player's hand is revealed. Each base wager is resolved by comparing the poker ranking of the player's hand to the poker ranking of the casino hand. The player is rewarded if the player's hand has a higher ranking than the dealer hand; otherwise, the player's base wager is collected by the casino. Bonus wagers are resolved by comparing the final player hand and the final dealer hand to a predetermined set of bonus holdings including, at least, a bonus holding in which the final player hand includes one joker, a bonus holding in which the final player hand includes two jokers, and a bonus holding in which the final dealer hand and the final player hand each include one joker.

4 Claims, 2 Drawing Sheets

CASINO GAME

RELATED APPLICATION DATA

The present invention is a continuation-in-part of U.S. patent application Ser. No. 09/267,191 filed Mar. 12, 1999, now abandoned, by applicant herein and entitled "Casino Game" which, in turn, claimed the benefit of U.S. Provisional Application serial No. 60/077,811 filed Mar. 12, 1998 by applicant herein.

FIELD OF THE INVENTION

The present invention relates to casino table and electronic-format card game. Specifically, the present invention is a casino card game and bonus wager, the bonus wager including at least one bonus holding contingent on both the dealer's holding and the player's holding.

BACKGROUND OF THE INVENTION

Card games such as Poker and Baccarat are well known forms of casino-type games. They provide excitement and entertainment to the players. In these games the players are looking for a game in which they have a reasonable chance of winning their wager and the casinos are looking for a reasonable return for hosting the game.

One such game referred to above is Poker where players play against each other to determine who has assembled the best Poker hand. Poker has many variations which can be broadly divided into two categories: those games where each player assembles the best Poker hand from that player's cards and those games where players use community cards to assemble the best five card Poker hand.

In Poker games in which players play against each other, the amount which can be won by a player is determined by the amount wagered by the players, i.e. the "pot". The drawback of this form of wagering is that if few players wager to conclusion of the hand or the wagers are small there is no opportunity for the player to win a relatively large amount in comparison to their wager.

There is a need for a game which provides for the player to play their individual Poker hand against a house dealer, which provides the opportunity for the player to win amounts significantly greater than the amount wagered by the player, which does not require the player to make additional wagers during the play of the game to obtain, for example, additional cards as is required in many variations of table poker games and which does not require the dealer to have a qualifying holding of cards for the player to fully participate in the game.

SUMMARY OF THE INVENTION

One embodiment of the present invention is a method for playing a casino game using a standard fifty two card deck plus at least one joker which acts as a wild card substituting for any other card. In an alternate embodiment, an electronic device using electronic representations of a fifty two card deck plus at least one joker is used. In a preferred embodiment, two jokers are used.

In the game of the present invention, one or more players play against a dealer. Each player places a base wager on the layout. The player also has an option to make a bonus wager. The dealer or electronic device deals a five card hand to each player and to the dealer. Each player compares his or her initial hand to a predetermined set of automatic winning holdings. Each player with an initial matching one of the automatic winning holdings is rewarded. Optionally, the reward includes paying the player according to an automatic winning holding pay table. A player having an automatic winning holding is excluded from further participation in the hand except to resolve the bonus wager after the dealer's cards are revealed.

The remaining players have the option to discard a single card and receive a single replacement card. In an optional embodiment, the replacement card is dealt face down and the player is not allowed to examine the replacement card.

A single additional card is dealt to the dealer face down and the dealer's six cards are revealed. The dealer forms a final dealer hand using the highest ranking five card poker hand possible from the dealer's six cards.

Each player's hand is revealed in turn. As each player's hand is revealed, the poker ranking of the player's hand is compared to the poker ranking of the dealer's hand. Standard poker rankings, known in the art, are used to rank the hands. Specifically, the hands are ranked in the following descending order: royal flush, five of a kind, straight flush, four of a kind, full house, flush, straight, three of a kind, two pair, one pair, and high card.

The base wagers are resolved by rewarding players having a hand with a higher poker ranking than the casino's hand and collecting the base wagers from players having a hand with a lower poker ranking than the dealer's hand. Payouts of greater than 1:1 may be available for predetermined poker hands.

Bonus wagers are resolved by comparing the final player hands with a predetermined schedule of bonus holdings. The bonus holdings include at least a bonus holding in which the final player hand includes one joker, a bonus holding in which the final player hand includes two jokers, and a bonus holding in which the final player hand includes one joker and the final dealer hand includes one joker.

DESCRIPTION

Figure 1:
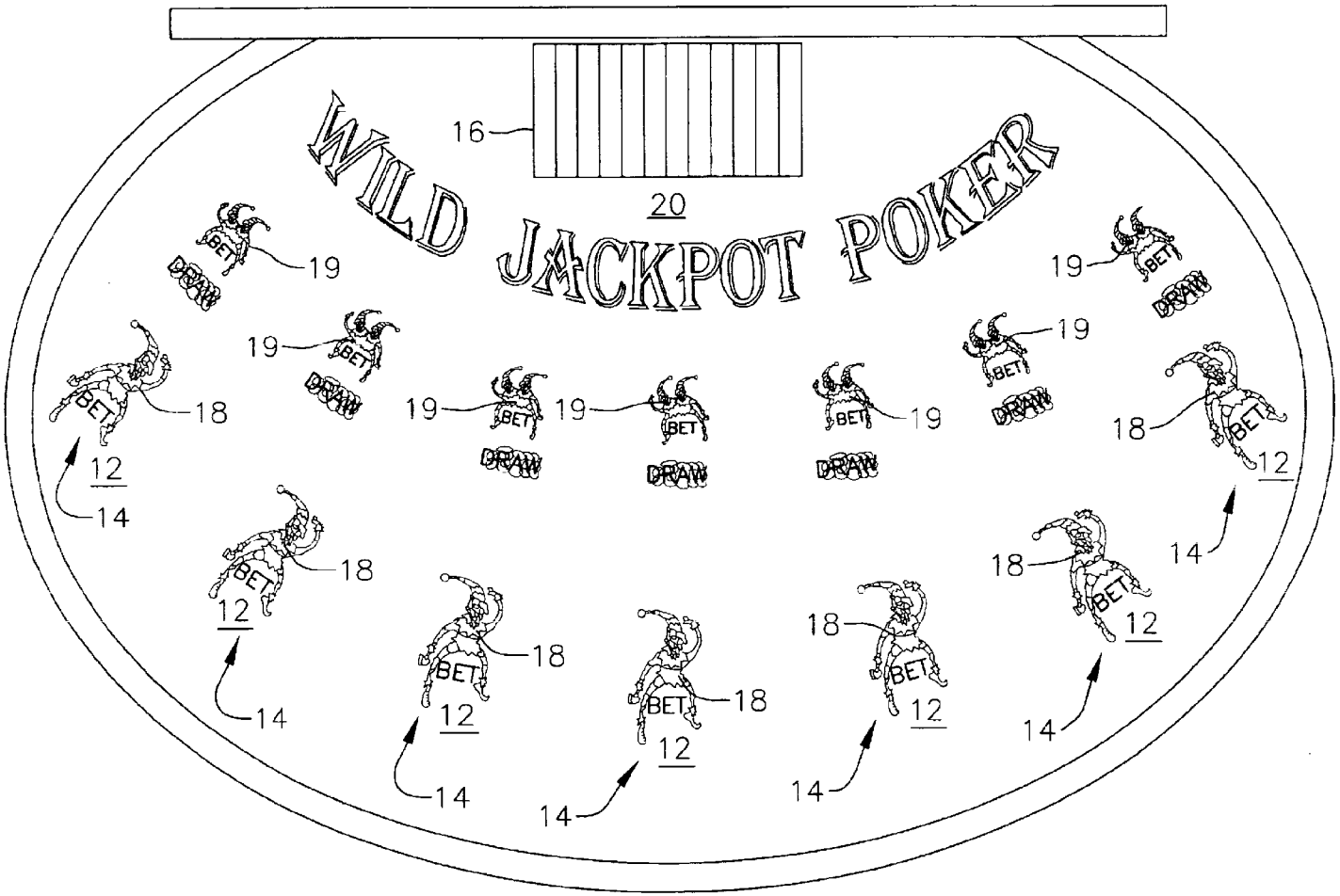
FIG. 1 shows a layout for the play of a game according to an embodiment of the method of the present invention.

Reference is now made to the figure wherein like parts are referred to by like numerals throughout. Referring to FIG. 1, there is shown a table layout 10 for the play of the game according to the method of the present invention. The table layout 10 is shown which includes seven player positions 12 spaced about the layout 10. Opposite the player positions 12 is a dealer position 34 having thereat a check tray 16 to hold the gaming tokens or chips paid out and received during play of the game. Each player position 12 is denoted by first indicia 18 which may be the logo of the casino or, as shown, a fanciful jester figure and a second indicia 19 which may be a depiction of a pot of gold. At the second indicia 19, an area on the layout 10 is provided to receive the player's bonus wager(s). The player lays the chosen wager on the corresponding area at the player's second indicia 19.

The action area 20 may be denoted by a larger version of the fanciful jester figure or other indicia. The action area 20 is the dealer's working area where the dealer plays the casino hand by receiving cards and revealing the casino hand. The layout 10 may include a paytable that lists the various bonus payouts available to the players during play of the game.

The game according to the method of the present invention is played using a standard deck of fifty-two playing cards with the addition of two wild cards or Jokers thus constituting a deck of fifty-four cards. The wild cards are wild and can be used to represent any playing card.

Figure 2:
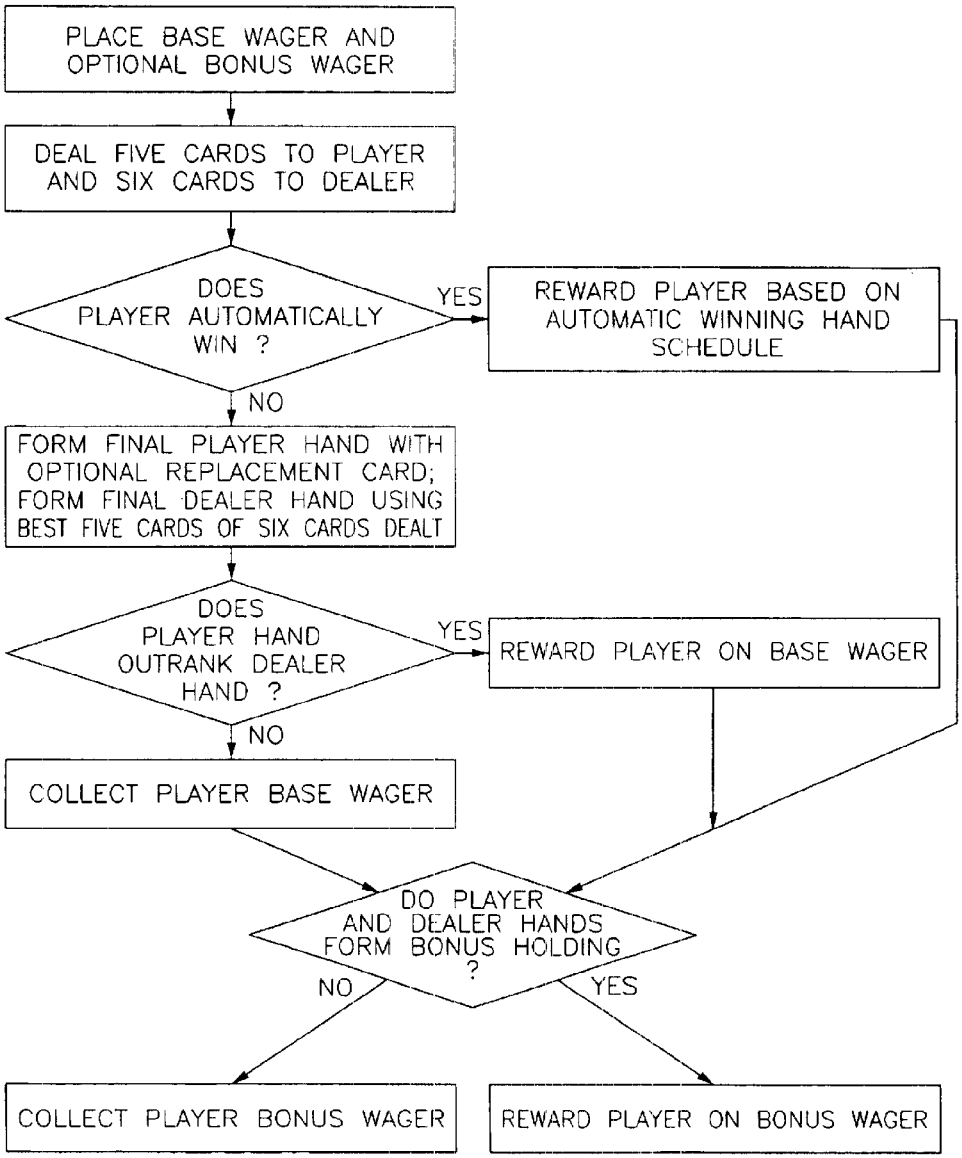
FIG. 2 shows a flowchart of a game method according to an embodiment of the present invention.

With the layout 10 set forth above, and with reference to FIG. 2, play of the game according to the method of the present invention will now be described.

Each player at a player position 12 makes a chosen base wager which is placed at the first indicia 18 on the bet indicia 14, and opts to make a bonus wager, which if made, is placed at the second indicia 19. The bonus wager is made within a designated table limit.

After the players have made their chosen wagers, the dealer deals to each player and to himself five cards, face down. The players assess their hands. If a player has made a bonus wager and his cards constitute an automatic winning holding, the player acknowledges this holding by placing his cards, face up in the area between the first and second indicia 18, 19. This signifies to the dealer that the player has an automatic winning holding. Preferably, base wagers are immediately resolved for players having an automatic winning holding by paying each player having an automatic winning holding according to the pay table shown below in Table 1.

TABLE 1

| | |
|---|---|
| Royal Flush (no Jokers) | 50:1 |
| Royal Flush (with Joker) | 10:1 |
| Five of a Kind | 5:1 |
| Straight Flush (no Jokers) | 3:1 |
| Straight Flush (with Joker) | 1:1 |
| Four of a Kind (no Joker) | 1:1 |
| Full House (no Joker) | 1:1 |
| Four of a Kind (with Joker) | 1:1 |
| Full House (with Joker) | 1:1 |
| Flush (no Joker) | 1:1 |
| Flush (with Joker) | 1:1 |
| Straight (with or without joker) | 1:1. |

These payouts may be varied if desired. After resolving the base wagers, players having automatic winning holdings are excluded from further participation in the game except to resolve bonus wagers and play continues with the remaining players who did not posses an automatic winning holding.

If a player does not have an automatic winning holding, he has an option to discard a single card and obtain a dealt replacement card from the dealer. In a preferred embodiment, the player indicates which card he wishes to discard by placing the discard card on the area indicated by the word "Draw" on the layout 10. The dealer collects the discard cards and deals a single replacement card to each player who discarded a card. Preferably, the players are not permitted to examine the replacement card.

After the players have completed their action, the dealer deals himself a single additional card and turns over his six card hand;. In an optional embodiment, a dealer may deal himself an initial hand of six cards rather than dealing an initial hand of five cards and a single additional card. The dealer arranges a final dealer hand by selecting the highest ranking five card poker hand, including the use of Jokers as a wild card, from among the dealer's six cards. For example, if the dealer's hand consists of K♡ K♢6♤ 9♤ A♡ 5♢, the dealer selects the pair of Kings from the other cards.

The dealer then, in order, turns over each player's hand and compares the player's final hand to the final dealer hand. If the player has a hand with a higher poker ranking higher than the dealer's hand, with or without the use of Jokers, the player is deemed the winner and the player is paid even money on the player's base wager. In an optional embodiment, the payout may be greater than even money. For example, in an optional embodiment, if the player hand outranks the dealer hand and the player has a hand listed in Table 1, the player is paid in accordance with the pay schedule of Table 1. If the dealer has a hand with a higher poker ranking than the player's hand, the dealer is declared the winner and the player's base wager is collected. The ranking of poker hands is conventional in the art and is shown below in Table 2.

TABLE 2

| |
|---|
| Any Royal Flush |
| Any Five of a Kind |
| Any Straight Flush |
| Four of a Kind |
| Full House |
| Flush |
| Straight |
| Three of a Kind |
| Two pair |
| One Pair |
| High Card. |

The composition of these hands may include, and in some cases must include, one or both of the Wild Jokers. After each player's hand has been resolved against the dealer and any payout made, the dealer resolves any bonus wager by comparing the final player hand and the final dealer hand to a predetermined set of bonus holdings and rewarding any player having a bonus holding. The bonus holdings may include any hands known in the art but include at least a bonus holding in which the player has one joker, a bonus holding in which the final player hand has two jokers, and a bonus holding in which the final player hand and the final dealer hand each have one joker. After resolving base and bonus wagers, the player's cards are removed from the layout 10 and the dealer moves to the next player to resolve that player's final hand in a like manner. When all hands have been resolved, players make new wagers, the deck is shuffled and a new hand is dealt. To speed play, an automatic'shuffler may be used.

The method of the play of the game can be incorporated into an electronic gaming machine. The machine has a processor which has a data structure including data representing each of the fifty-four cards, bonus holdings, automatic winning holdings, and Poker rankings. The machine also has a display communicating with the processor. The player inputs the base and bonus wagers and initiates play whereupon the processor randomly selects five cards from the data structure for each player hand and a dealer hand. The processor displays the cards and resolves the hands in the manner described above.

In an optional embodiment, the player may play multiple player hands against the dealer hand. In such an embodiment, the machine receives input from the player indicating the number of hands the player wishes to play against the dealer and the number of coins the player wishes to wager on each individual hand. In one optional embodiment, the player may play one to five hands and may wager one to five coins on each hand. Play of the game begins with the player inputting base and bonus wagers and indicating the number of hands and the amount wagered on each hand, whereupon the processor randomly selects five cards for each hand played. The player hands and the dealer hand are displayed face down in a miniaturized fashion. Player hands including automatically winning holdings are exposed and credits awarded according to an automatic winning holding paytable. For remaining hands, as the player serially selects each hand for play, the hand is magnified from the miniaturized display and the player inputs which card, if any, the player wishes to replace. After forming a final player hand from the selected hand, the hand is miniaturized and the next hand is magnified and played to completion. After all the player's hands are played to completion, the processor deals a single additional card to the dealer and the processor forms the highest ranking hand possible from the dealer's six cards. Each player hand is resolved against the dealer's hand and credits are debited or awarded according to the comparison of each hand. Bonus wagers on the inclusion of one or more jokers in the player hand or one joker in each of the player and dealer hands are resolved after resolution of the base wagers.

As can be appreciated the players can win by besting the dealer's hand and/or by obtaining a bonus outcome. It has been determined that the game according to the present invention presents a game with a statistical house advantage from between 3.7% to 3.4% which is comparable to such games as video poker and the like.

While certain embodiments of the present invention have been shown and described it is to be understood that the present invention is subject to many modifications and changes without departing from the spirit and scope of the claims presented herein.

I claim:

1. A method for playing a casino game in which at least one player plays against a dealer using a standard fifty two card deck plus at least two jokers, comprising:

the player making a base wager and a bonus wager;

dealing to the player an initial player hand of five cards;

dealing to the dealer a hand of six cards face down;

the player examining the initial player hand and comparing the cards of the initial player hand to a predetermined set of automatic winning holdings;

resolving the base wager, comprising:

(a) if the player's initial player hand matches one of the automatic winning holdings, issuing a reward to the player based on the player's base wager according to a predetermined automatic winning holding schedule, the reward being greater than even money for a predetermined designated subset of the automatic winning holdings, the player being excluded from further participation in the hand after being rewarded; and (b) if the player does not have an automatic winning holding, (i) the player opting to discard a single card from the player's initial player hand and receive a single replacement card to form a final player hand;

(ii) revealing the dealer's six cards;

(iii) the dealer forming a final dealer hand of the highest ranking five card poker hand contained among the dealer's six cards;

(iv) comparing the poker ranking of the player's final player hand to the poker ranking of the final dealer hand; and (v) rewarding the player based on his base wager if the final player hand has a higher poker ranking than the final dealer hand, the reward being greater than even money if the final player hand matches one of a predetermined set of holdings, and collecting the player's base wager if the final player hand has a lower poker ranking than the final dealer hand; and resolving bonus wagers by comparing the final player hand and the final dealer hand to a predetermined set of bonus holdings and rewarding the player based on his bonus wager for having a bonus holding, the set of bonus holdings including at least a bonus holding in which the final player hand includes one joker, a bonus holding in which the final player hand includes two jokers, and a bonus holding in which the final player hand includes one joker in combination with the final dealer hand simultaneously including one joker.

2. The casino game of claim 1 wherein said step of comparing the poker ranking of each player's hand to the poker ranking of the casino's hand includes ranking the hands in the following descending order:

| |
|---|
| Any Royal Flush |
| Any Five of a Kind |
| Any Straight Fush |
| Four of a Kind |
| Full House |
| Flush |
| Straight |
| Three of a Kind |
| Two pair |
| One Pair |
| High Card. |

3. The casino game of claim 1 wherein said automatic winning holdings and rewards comprise the following pay table:

| | |
|---|---|
| Royal Flush (no Jokers) | 50:1 |
| Royal Flush (with Joker) | 10:1 |
| Five of a Kind | 5:1 |
| Straight Flush (no Jokers) | 3:1 |
| Straight Flush (with Joker) | 1:1 |
| Four of a Kind (no Joker) | 1:1 |
| Full House (no Joker) | 1:1 |
| Four of a Kind (with Joker) | 1:1 |
| Full House (with Joker) | 1:1 |
| Flush (no Joker) | 1:1 |
| Flush (with Joker) | 1:1 |
| Straight (with or without Joker) | 1:1. |

4. An apparatus for playing a casino game in which a player plays at least one hand against a dealer using electronic representations of a standard fifty-two card deck plus at least two jokers, comprising:

a display;

a processor in communication with said display, said processor having a data structure storing data representing each of the fifty-four cards, poker rankings, a bonus pay table, a set of automatic winning holdings, and a set of bonus holdings;

means for accepting base wagers and bonus wagers from the player in communication with said processor;

means for issuing rewards in communication with said processor;

means for initiating play in communication with said processor, whereby when a player initiates play, said processor randomly selects five cards from the data structure for each hand and displays a five card initial dealer hand and a five card initial player hand at said display, the processor resolving said base wager by comparing the player's initial hand to the stored automatic winning holdings and communicating a signal to issue a reward at said reward issuing means if the player's initial hand matches one of the automatic winning holdings, the reward being greater than even money if the initial player hand matches a predetermined subset of said automatic winning holdings, the player being excluded from further participation for a hand containing an automatic winning holding;

means for the player to select a single card to discard, whereby when a player indicates that a card is to be discarded, the processor randomly selects a replacement card from the deck depleted by the dealt cards and displays the replacement card at the display, after which said processor deals a single additional card to the dealer hand and forms a final dealer by selecting the highest ranking poker hand possible from the dealer's six cards, the processor resolving said base wager by rewarding said player if said player hand has a higher poker ranking than said dealer hand and retaining said base wager if said player hand has a lower poker ranking than said dealer hand; and means for issuing a bonus award to a player based on the player's bonus wager, the bonus award issued if the final player hand and the final dealer hand match one of a set of predetermined bonus holdings, the set of bonus holdings including at least a bonus holding in which the final player hand includes one joker, a bonus holding in which the final player hand includes two jokers, and a bonus holding in which the final player hand includes one joker in combination with the final dealer hand simultaneously including one joker.

* * * * *